United States Patent [19]

Cervenec et al.

[11] Patent Number: 4,503,937

[45] Date of Patent: Mar. 12, 1985

[54] ELEVATOR CONTROL CIRCUIT

[75] Inventors: Stephen W. Cervenec, Perrysburg; Ronald L. Stender, Maumee, both of Ohio

[73] Assignee: Schindler Haughton Elevator Corporation, Toledo, Ohio

[21] Appl. No.: 445,897

[22] Filed: Dec. 1, 1982

[51] Int. Cl.[3] ..... B66B 1/32

[52] U.S. Cl. ..... 187/29 R

[58] Field of Search ..... 187/29

[56] References Cited

U.S. PATENT DOCUMENTS

| | | | |
|---|---|---|---|
| 4,034,856 | 7/1977 | Wehrli et al. | 187/29 |
| 4,083,431 | 4/1978 | Oohira et al. | 187/29 |
| 4,084,662 | 4/1978 | Tezuka et al. | 187/29 |

*Primary Examiner*—William M. Shoop
*Assistant Examiner*—W. E. Duncanson, Jr.
*Attorney, Agent, or Firm*—Fraser & Clemens

[57] ABSTRACT

The present invention relates to a control circuit for a low inertia elevator system which utilizes an AC motor in conjunction with an eddy current brake to control the elevator car position. The control circuit includes a pattern generator for generating a pattern signal to a motoring gain amplifier and a braking gain amplifier. The pattern signal represents the desired speed of the car and includes an acceleration portion, a full speed portion, and a deceleration portion. The motoring gain amplifier and the braking gain amplifier are responsive to the pattern signal and a tach signal representing the actual speed of the car for controlling the AC motor and the eddy current brake respectively. In order to minimize the bump when the car enters the deceleration pattern, the pattern generator sets the initial level of the deceleration pattern at a value which is a function of the level of the tach signal at that time. The control circuit also includes a sensing circuit for determining whether the car is in an overhauling condition. If an overhauling condition is detected, the response time of the braking gain amplifier is increased during deceleration in order to permit the motoring gain to fall off more rapidly. This results in a smoother deceleration run along with reduced power consumption.

18 Claims, 14 Drawing Figures

FIG. 5A (LINE 190)

FIG. 5B (LINE 186)

ELEVATOR CONTROL CIRCUIT

BACKGROUND OF THE INVENTION

1. Field of the Invention

The present invention relates in general to a control circuit for controlling an AC motor of an elevator system and, in particular, to a control circuit for use in an elevator system which utilizes an AC drive motor in conjunction with an eddy current brake.

2. Description of the Prior Art

In previous elevator control circuits for AC motors, phase control of SCR's was utilized to control the motor speed and the position of an associated elevator car. These circuits typically included a motoring gain amplifier responsive to a tachometer signal representing actual car speed and a pattern signal representing the desired car speed for generating a motoring gain signal to control the SCR's. The pattern signal generally consisted of an acceleration portion, a full speed portion, and a deceleration portion. In order to control the motor, a reduced voltage was applied to the motor during acceleration, and the SCR's were fully turned on for a full speed run.

In those systems, a relatively large flywheel was attached to the motor shaft to assist in providing smooth acceleration and deceleration of the associated elevator car. The flywheel provided sufficient inertia such that when the elevator car was traveling in a full load, hauling condition in the up direction, all the power could be removed from the motor at a certain slowdown point and the rotational energy of the flywheel was generally sufficient to move the car to the selected floor. In instances wherein the flywheel provided too much inertia, contactors connecting the motor to the power source would be reversed and power applied to the motor to provide braking of the car. The contactors to the motor would also be reversed in the event an overhauling condition was detected One of the problems associated with AC systems occurs during the transition period when the control circuit is switching from the full speed portion into the deceleration portion of the pattern signal. In some instances, depending on different conditions such as the actual speed of the car, such a transition period produces a bump which is transmitted to the passengers in the car.

SUMMARY OF THE INVENTION

The present invention relates to a control circuit for a low inertia elevator system which utilizes an AC motor in conjunction with an eddy current brake to control the elevator car position. The present invention includes several features which result in smoother acceleration and deceleration of the car while providing a system which results in reduced power consumption over the prior art control systems.

The control system according to the present invention includes a pattern circuit for generating a pattern signal to a motoring gain control circuit and a braking gain control circuit. The pattern signal represents the desired speed of the car over a predetermined distance and includes an acceleration portion, a full speed portion, and a deceleration portion. The motoring gain control circuit is responsive to the pattern signal and a tachometer signal representing the actual speed of the car for generating a motor gain control signal to an SCR firing circuit. The SCR firing circuit utilizes the motoring gain signal to control the firing angle of the SCR's. In order to minimize the bump at slowdown associated with the prior art systems, the pattern circuit sets the initial level of the deceleration portion of the pattern signal at a value which is a function of the level of the TACH signal. Thus, when the car reaches a certain slowdown point wherein the pattern signal switches from the full speed portion to the deceleration portion, the error between TACH signal and the pattern signal is controlled to minimize any bump. In prior art systems, if this error was sufficiently large, a bump would occur when the car reached the slowdown point.

The present invention also includes means for sensing whether the elevator car is in an overhauling condition and for altering the response time of the braking control circuit in the event the car is overhauling. In the preferred embodiment of the invention, if an overhauling condition is sensed, the gain of the braking control circuit is reduced during deceleration to reduce the response of the braking circuit. This causes the motoring gain signal to fall off more rapidly and then permits the braking gain control circuit to respond by braking the system. Such a control circuit results in reduced power consumption over the prior art systems.

In addition to the above features, the present invention also includes means for providing a smooth transition into the acceleration run of the car, and means for providing a smooth transition into deceleration run of the car. The smooth acceleration feature is accomplished by presetting the level of the motoring gain signal to a level corresponding to the lower edge of the active region of the SCR's at the beginning of a car run. This eliminates the delay period associated with prior art driving systems in which the motoring gain signal was gradually increased to this level. In order to provide a smooth transition into the deceleration run, the motoring gain voltage, which during a full speed run is typically at a voltage which maintains the SCR's in a full on state at a level a predetermined amount above the active region of the SCR's during a full speed run, is quickly reduced to a level corresponding to the upper edge of the active region of the SCR's when the car is to enter a deceleration run.

BRIEF DESCRIPTION OF THE DRAWINGS

FIGS. 5*a* through 5*c* are waveform diagrams generated by the circuit of FIG. 4 and illustrating the manner in which the crude pattern signal is combined with the ideal pattern signal to produce the actual pattern signal;

DESCRIPTION OF THE PREFERRED EMBODIMENT

Figure 1:
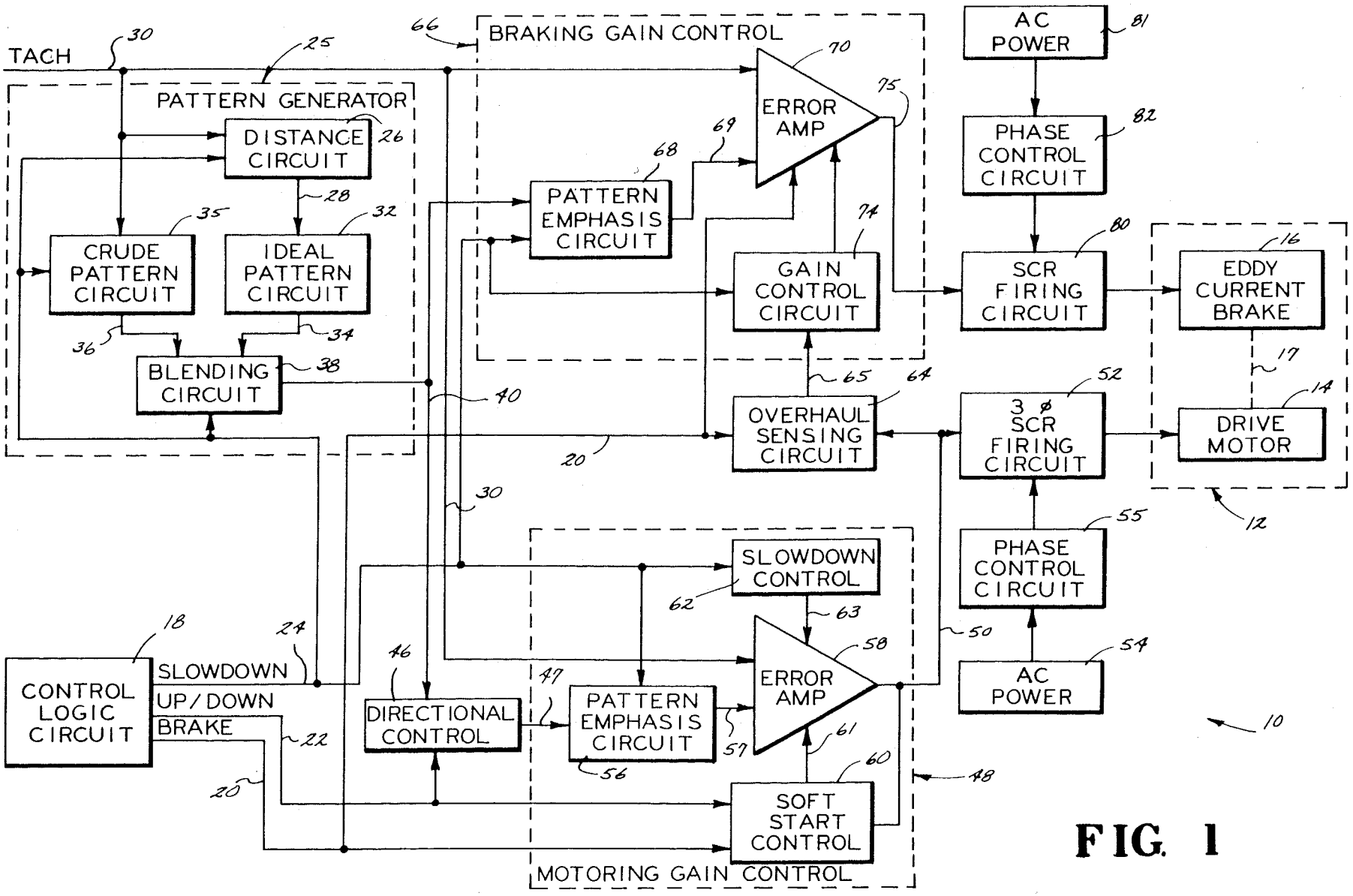
FIG. 1 is a block diagram illustrating the elevator control system of the present invention.

Referring to FIG. 1, there is shown in block diagram form an elevator control system according to the present invention. The elevator control system 10 is adapted to control a driving device 12 consisting of an AC drive motor 14 and an eddy current brake 16 having a common rotor shaft represented by dashed line 17. While not shown in the drawings, the rotor shaft is coupled to a counterweight and cable assembly for controlling the position of an associated elevator car.

The control system 10 includes a control logic circuit 18 which generates a plurality of logic signals representing various status conditions of the elevator car. For example, the control logic circuit 18 generates a brake signal on a line 20 to indicate whether a friction brake (not shown) is engaged or disengaged from the rotor shaft 17. The control logic circuit 18 generates an UP/-DOWN signal on a line 22 representing whether the car is traveling in an up or down direction. The control logic circuit also generates a SLOWDOWN signal on line 24 when the car reaches a position which is a predetermined distance from the floor at which a stop is to be made. As will be discussed, these control logic signals are utilized to control and activate various portions of the circuit 10 in order to control the car in a particular manner. It should be noted that the control logic circuit 18 can be adapted to generate control signals other than those discussed above.

The control system 10 includes a pattern generator 25 having a distance circuit 26 which generates an output signal on a line 28 representing the distance the car is from the desired floor location at which it is to stop. The distance circuit receives input signals which include the SLOWDOWN signal on the line 24 and a TACH signal on a line 30. The TACH signal is an analog signal representing the actual speed of the car. The distance signal is an input to an ideal pattern circuit 32 which generates an ideal pattern signal on a line 34 representing the particular pattern the tachometer voltage should follow in order to achieve smooth acceleration and deceleration of the car.

The pattern generator 25 includes a crude pattern circuit 35 which generates a crude pattern signal on a line 36 when the circuit 35 receives the SLOWDOWN signal on the line 24. The ideal pattern signal and the crude pattern signal on the lines 34 and 36 respectively are inputs to a blending circuit 38 which generates an actual pattern signal on a line 40. Normally, the ideal pattern signal is passed through the blending circuit 36 substantially unchanged such that the actual pattern signal on the line 40 is substantially identical to the ideal pattern signal on the line 34. However, as will be discussed below, when the SLOWDOWN signal is generated on the line 24, the crude pattern signal on the line 36 is utilized to momentarily alter the ideal pattern signal to generate the actual pattern signal. As will be discussed, the ideal pattern signal is altered in a manner to minimize any bumps normally produced when the car enters a deceleration run.

Figure 2A:
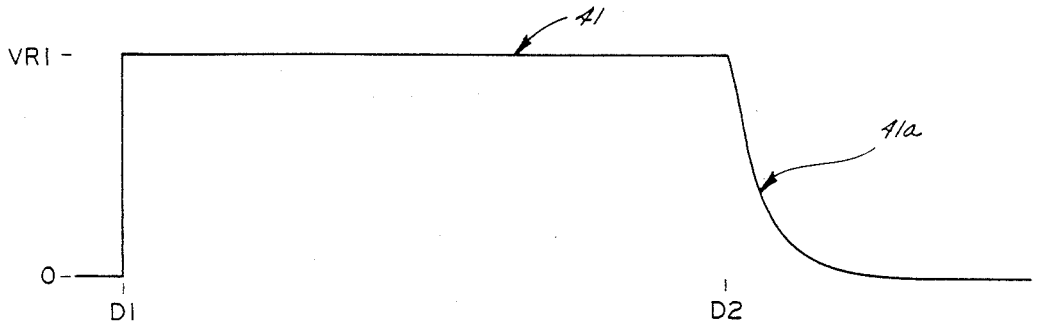
FIGS. 2*a* through 2*c* are waveform diagrams generated by the system of FIG. 1 which illustrate the manner in which the deceleration portion of the pattern signal is generated to provide a smooth transition into the deceleration run.
Figure 2B:
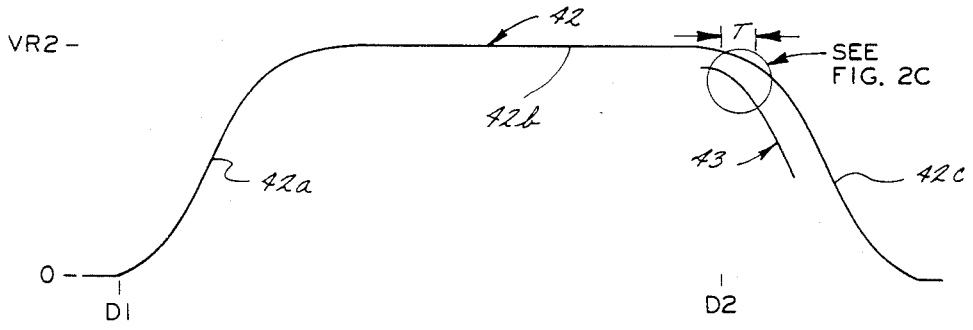
Figure 2C:
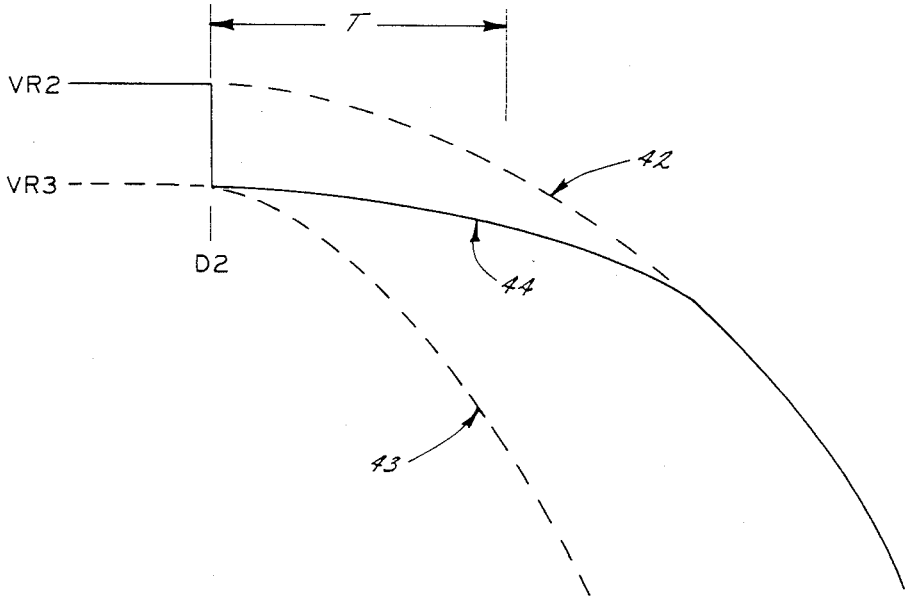

Referring to FIGS. 2*a*, 2*b* and 2*c*, these waveforms will now be utilized to briefly discuss the manner in which the ideal pattern signal on the line 34 is momentarily blended with the crude pattern signal on the line 36 at the slowdown point to produce an actual pattern signal which results in a smooth transition into the deceleration run. FIG. 2*a* illustrates a distance signal waveform 41 generated by the distance circuit 26 on the line 28. When the car begins to accelerate at point D1, the distance voltage jumps from approximately zero volts to a VR1 potential. The VR1 potential is selected to represent the distance between a particular slowdown point and the corresponding floor. Typically, this distance is approximately 7.5 feet. When the car reaches a slowdown point D2 corresponding to the desired floor, the distance circuit begins to integrate the TACH signal on the line 30 to generate a negative sloped signal 41*a* representing the actual distance the car is from the desired floor.

The solid line 42 in FIG. 2*b* represents the ideal pattern signal on the line 34. As will be discussed in more detail hereinafter, the ideal pattern circuit 32 includes circuitry responsive to the distance signal on the line 28 for providing an acceleration pattern 42*a* to control the acceleration run of the car, a full speed run pattern 42*b* at a voltage VR2, and a deceleration pattern 42*c* for controlling the deceleration of the car. The waveform 43 in FIG. 2*b* represents the crude pattern signal generated on the line 36. In accordance with the present invention, the ideal pattern signal on the line 36 is blended with the crude pattern signal on the line 38 over a predetermined time period, represented as time period T in FIG. 2*b*, to generate the actual pattern, signal on the line 40. An enlargement of the actual pattern signal in this portion of FIG. 2*b* is shown in FIG. 2*c*.

The blending circuit 38 is utilized to control the blending of the ideal pattern signal and the crude pattern signal over the time period T. As shown in FIG. 2*c*, immediately at the slowdown point D2, the blending circuit alters the ideal pattern signal 42 (continued in dashed form) by setting the signal to a lower potential level VR3 corresponding to the level of the crude pattern signal 43 (shown in dashed form) to produce the actual pattern signal 44 (shown as a solid line). As will be discussed, the level VR3 is a value which is a function of the actual speed of the car at the point D2. From the point D2, the actual pattern signal 44 generated on the line 40 gradually returns to the level of the ideal pattern signal such that, at the end of the time T, the actual pattern signal is substantially equal to the ideal pattern signal. The exact manner in which the ideal and crude pattern signals are generated and blended will be discussed in more detail hereinafter.

The actual pattern signal on the line 40 is supplied through a directional control circuit 46 on a line 47 to a motoring gain control circuit 48 as shown in FIG. 1. The directional control 46 controls the polarity of the actual pattern signal on the line 40 based on whether the car is traveling in an up or a down direction. The motoring gain control 48 is responsive to the polarized pattern signal on the line 47 and the TACH signal on the line 30 for generating a motoring gain signal on a line 50 to a three phase SCR firing circuit 52. The firing circuit 52 receives an AC power signal from an AC power source 54 through a phase control circuit 55. The firing circuit 52 is connected to operate the drive motor 14.

The motoring gain control circuit 48 includes a pattern emphasis circuit 56 which receives the SLOWDOWN signal on the line 24 and generates the pattern signal on a line 57 as an input to an error amplifier 58.

As will be discussed, during a full speed run condition, the pattern emphasis circuit 56 functions to supply the pattern signal to the error amplifier 58 at a slightly increased level, thus making it appear to the error amplifier 58 that the car is traveling at a speed less than the desired speed. This causes the error amplifier to generate a motoring gain signal on the line 50 which maintains the SCR's of the circuit 52 in a fully on state. At slowdown, the circuit 56 switches to supply the pattern signal at the same input circuitry as the TACH signal.

The motoring gain control 48 includes a soft start control 60, which is responsive to the BRAKE signal on the line 20, the UP/DOWN signal on the line 22, and the motoring gain signal on the line 50 for generating an initial start up control signal to the error amplifier 58 on a line 61 which causes the error amplifier 58 to generate a motoring gain signal on the line 50 at a level just below the level at which the SCR's begin to turn on. The motoring gain control 48 also includes a slowdown control circuit 62 which receives the SLOWDOWN signal on the line 24. As will be discussed, when the SLOWDOWN signal is generated, the slowdown control 62 causes the error amplifier motoring gain signal on the line 50 to be preset at a level corresponding to the upper edge of the active region of the SCR's.

An overhaul sensing circuit 64 is connected to monitor the level of the motoring gain signal on the line 50 in order to determine whether an overhauling condition exists. If an overhauling condition is sensed, the overhauling sensing circuit 64 generates an overhaul logic signal on the line 65 to a braking gain control circuit 66.

The braking gain control circuit 66 includes a pattern emphasis circuit 68 which receives the pattern signal on the line 40 and the SLOWDOWN signal on the line 24. The pattern emphasis circuit 68 functions in a manner similar to the pattern emphasis circuit 56 such that, during a full speed run condition, the pattern signal voltage supplied on a line 69 to an error amplifier 70 is slightly above the level of the TACH signal. A gain control circuit 74 is connected to receive the output signal from the overhaul sensing circuit 64 on the line 65.

In accordance with the present invention, if the overhauling logic signal indicates an overhauling condition, the gain control circuit 74 causes the gain of the error amplifier 70 to be reduced when the car reaches the slowdown point. This causes the response time of the braking gain control circuit to be reduced which, as will be discussed, results in improved braking of the overhauling load. The error amplifier 70 generates a braking gain signal on a line 75 to an SCR firing circuit 80 which receives an AC power signal from an AC power source 81 through a phase control circuit 82. The SCR firing circuit 80 is connected to operate the eddy current brake 16.

Figure 3:
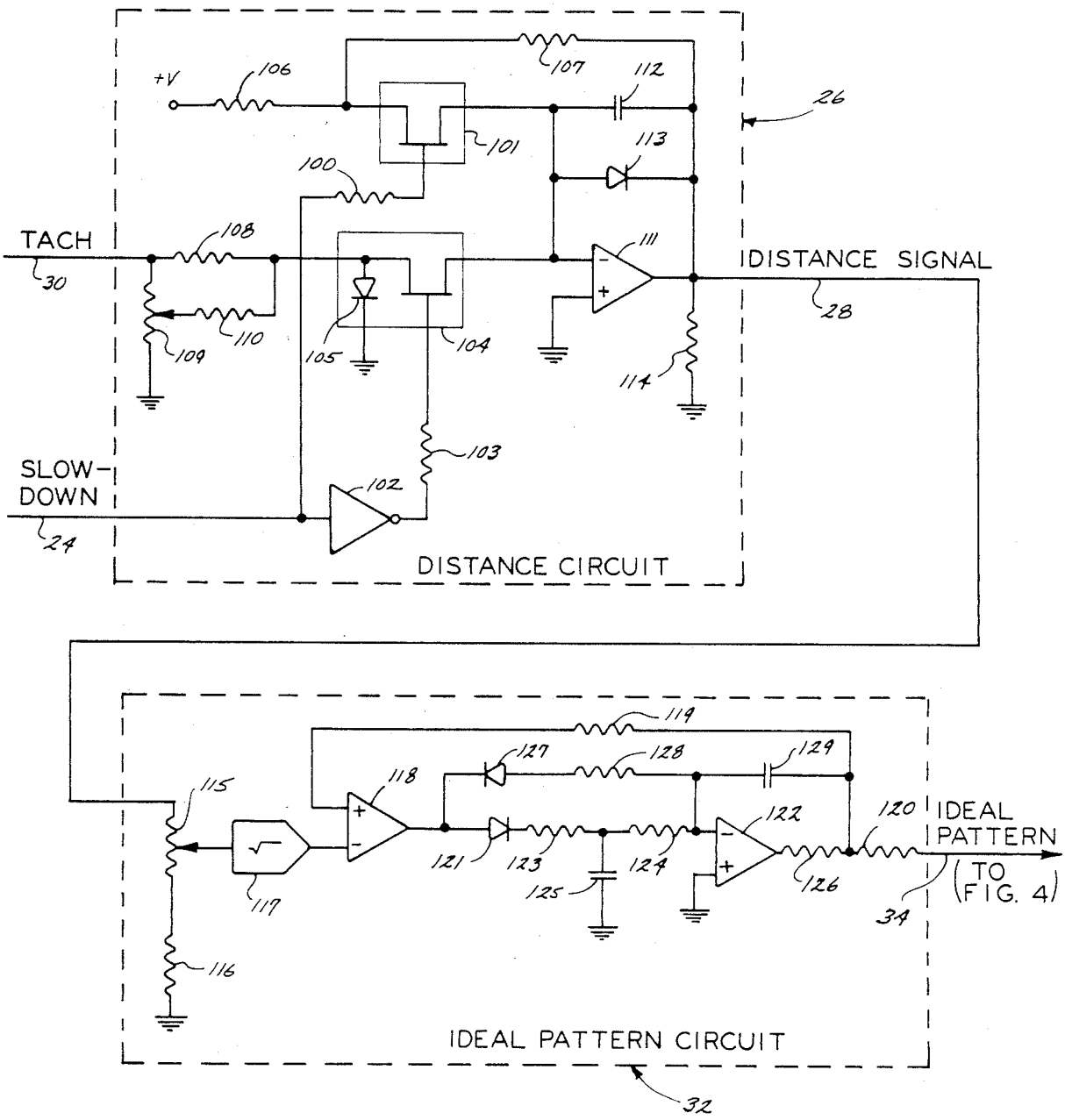
FIG. 3 is a schematic diagram illustrating the distance circuit and the ideal pattern circuit of FIG. 1.

Referring to FIG. 3, there is shown a schematic diagram of the distance circuit 26 and the ideal pattern circuit 32 of FIG. 1. The SLOWDOWN signal on the line 24 is connected through a resistor 100 to the switching input of a MOSFET switch 101. The SLOWDOWN signal is also connected through an inverter 102 and a resistor 103 to the switching input of a second MOSFET switch 104. The MOSFET switch 104 has one terminal pulled to ground through an internal diode 105. A resistor 106 is connected between a +V power supply and one terminal of the switch 101. Another resistor 107 is connected to the junction of the resistor 106 and the switch 101 and the distance signal output line 28.

The TACH signal on the line 30 is supplied to the switch 104 through a resistor 108 connected to the terminal which is pulled to ground. A potentiometer 109 has one fixed terminal connected to the TACH signal line 30 and the other fixed terminal connected to the circuit ground potential. The variable terminal of the potentiometer 109 is connected to the junction of the resistor 108 and the switch 104 through a resistor 110. A third terminal of each of the switches 101 and 104 is connected to an inverting input of an amplifier 111. A non-inverting input of the amplifier 111 is connected to the circuit ground potential.

A capacitor 112 is connected between the inverting input and an output of the amplifier 111. A diode 113 has an anode connected to the inverting input and a cathode connected to the output of the amplifier 111. The output of the amplifier is connected to generate the distance signal on the output line 28. The output of the amplifier 111 is also connected to the circuit ground potential through a resistor 114.

Before the car reaches the slowdown point, the SLOWDOWN signal is at a low logic level such that the switch 101 is in the on state and the switch 104 is in the off state. In this case, the voltage generated on the line 28 is determined by the voltage divider consisting of the resistor 106, the resistor 107, the diode 113, and the resistor 114. As shown in FIG. 2*a*, this voltage level is at the VR1 potential. As previously mentioned, the VR1 potential represents the distance between a particular slowdown point and the corresponding floor position.

When the car reaches the slowdown point, the logic level of the SLOWDOWN signal will switch from low to high. This causes the switch 101 to turn off and the switch 104 to turn on. When the switch 104 is turned on, the TACH signal on the line 30 is applied to the inverting input of the amplifier 111. The amplifier 111 along with the capacitor 112 and other associated circuitry function to integrate the TACH signal to generate a voltage on the output line 28 representing the distance the car is from the desired floor. Such integration results in the negative-sloped portion 41*a* of the distance signal shown in FIG. 2*a*.

The output line 28 is connected as an input to the ideal pattern circuit 32. The line 28 is connected to one fixed terminal of a potentiometer 115 having the other fixed terminal connected through a resistor 116 to the circuit ground potential. The variable input of the potentiometer 115 is connected to the input of a square root amplifier 117. The output of the square root amplifier 117 is connected to an inverting input of an amplifier 118 having a non-inverting input connected to an ideal pattern output line 34 through a resistor 119 and a resistor 120. The output of the amplifier 118 is connected to the anode of a diode 121 having a cathode connected to the inverting input of an amplifier 122 through a pair of series connected resistors 123 and 124. A capacitor 125 has one terminal connected to the junction of the resistors 123 and 124 and the other terminal connected to the circuit ground potential. The non-inverting input of the amplifier 122 is connected to the circuit ground potential. The output of the amplifier 122 is connected to the output line 34 through a resistor 126 and the resistor 120. The output of the amplifier 118 is connected to the cathode of a diode 127 having an anode connected to the inverting input of the amplifier 122 through a resistor 128. A capacitor 129 has one terminal connected to the junction of the resistors 126 and 120 and another terminal connected to the inverting input of the amplifier 122.

The ideal pattern circuit 32 functions to generate an ideal pattern signal on the output line 34 similar to the solid line waveform 42 shown in FIG. 2*b*. The square root amplifier 117 and the amplifiers 118 and 122 cooperate to shape the waveform in such a manner. The maximum rate of acceleration and deceleration is controlled by the value of the the capacitor 129. When the distance circuit 26 begins to generate the distance signal on the line 28, the square root amplifier 117 generates a signal to the inverting input of the amplifier 118 representative of the square root of the signal level at the input of the amplifier 117. The output of the amplifier 118 is then supplied to the inverting input of the amplifier 122 through the diode 121 and the resistor and capacitor network consisting of the resistors 123 and 124 and the capacitor 125. The resistor 123 and the capacitor 125 are selected to provide initial shaping of the acceleration pattern 42*a* shown in FIG. 2*b*.

The amplifier 122 functions to integrate the signal at a rate determined by the values of the resistor 124 and the capacitor 129. Once the signal reaches the voltage level VR2 shown in FIG. 2*b*, the voltage will remain at this level until the distance circuit 26 receives the SLOWDOWN signal on the line 24. At this time, the signal level at the output of the square root amplifier 117 will begin to fall and will have a negative polarity with respect to the signal at the inverting input of the amplifier 122. This results in the signal being supplied to the input of the amplifier 122 through the diode 127 and the resistor 128. The amplifier 122 functions as an integrator to integrate at a negative rate determined by the values of the resistor 128 and the capacitor 129. This produces the deceleration pattern 42*c* of the ideal pattern signal shown in FIG. 2*b*.

Figure 4:
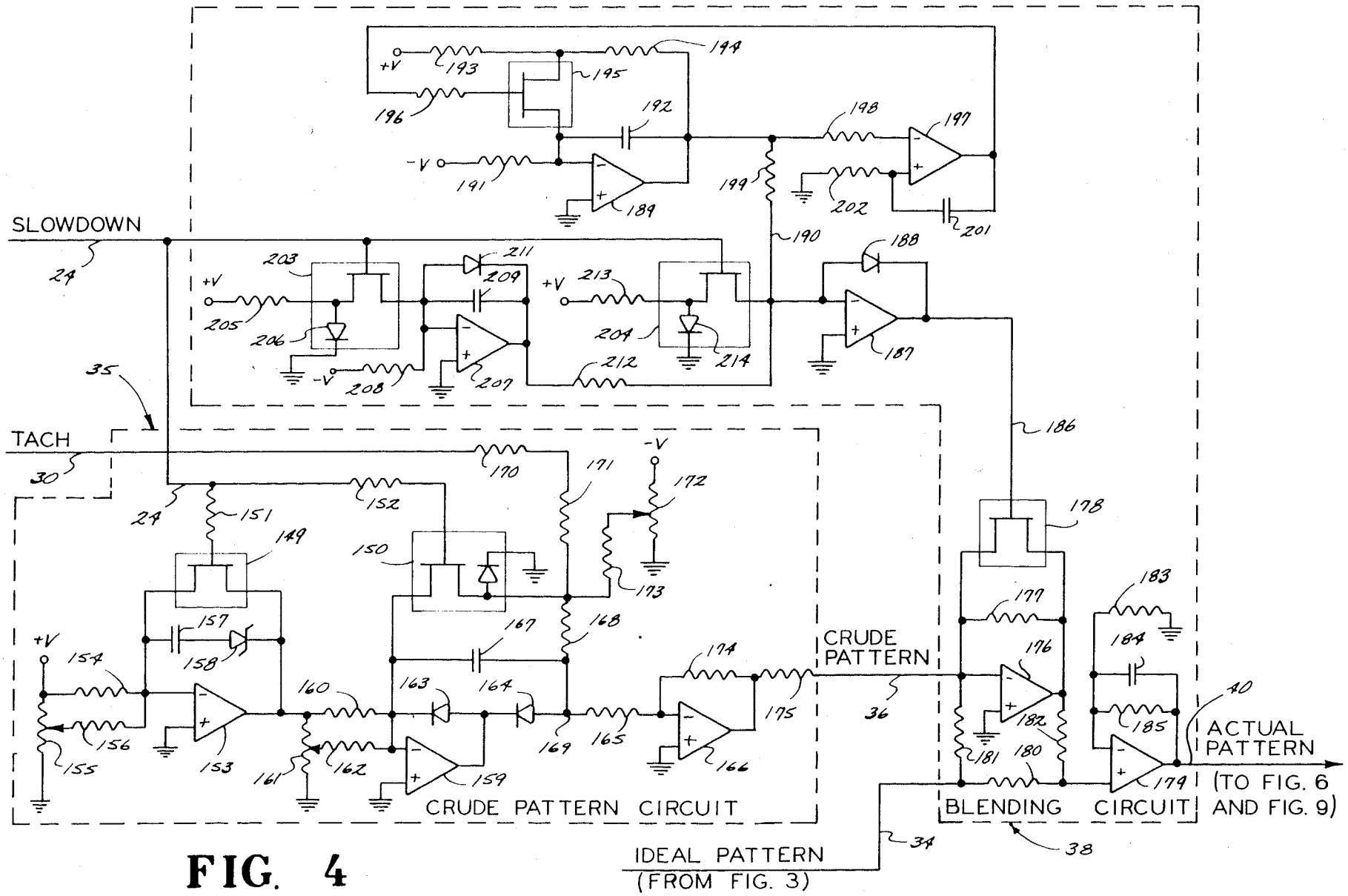
FIG. 4 is a schematic diagram illustrating the crude pattern generator and the blending circuit of FIG. 1.

Referring to FIG. 4, there is shown a schematic diagram of the crude pattern circuit 35 and the blending circuit 38 shown in block diagram form in FIG. 1. The crude pattern circuit 35 includes a pair of MOSFET switches 149 and 150 having switching inputs connected to receive the SLOWDOWN signal on the line 24 through resistors 151 and 152, respectively. The MOSFET switch 149 has one terminal connected to the inverting input and the other terminal connected to the output of an amplifier 153. The inverting input of the amplifier 153 is connected to a +V power supply through a resistor 154. A potentiometer 155 has one fixed terminal connected to the +V power supply and the other fixed terminal connected to the circuit ground potential. The variable terminal of the potentiometer 155 is connected to the inverting input of the amplifier 153 through a resistor 156. The non-inverting input of the amplifier 153 is connected to the circuit ground potential.

A capacitor 157 has one terminal connected to the inverting input of the amplifier 153 and another terminal connected to the anode of a Zener diode 158 having a cathode connected to the output of the amplifier 153. The output of the amplifier 153 is supplied to the inverting input of another amplifier 159 through a resistor 160. A potentiometer 161 has one fixed terminal connected to the output of the amplifier 153 and another fixed terminal connected to the circuit ground potential. The variable terminal of the potentiometer 161 is connected to the inverting input of the amplifier 159 through a resistor 162.

The non-inverting input of the amplifier 159 is connected to the circuit ground potential. A diode 163 has an anode connected to the output and a cathode connected to the inverting input of the amplifier 159. The output of the amplifier 159 is connected to the cathode of a diode 164 having an anode connected to the inverting input of an amplifier 166 through a resistor 165. A capacitor 167 has one terminal connected to the junction point 169 between the diode 164 and the resistor 165 and another terminal connected to the inverting input of the amplifier 159. The switch 150 has one terminal connected to the inverting input of the amplifier 159 and another terminal connected to the junction point 169 through a resistor 168.

The TACH signal on the line 30 is applied to the junction point 169 through resistors 170, 171 and 168 connected in series. A potentiometer 172 has one fixed terminal connected to the −V power supply and the other fixed terminal connected to ground potential. The variable terminal of the potentiometer 172 is connected to the junction between the resistors 171 and 168 by a resistor 173. The potentiometer 172 is adjusted to provide a reduced level tach signal to the junction point 169. A resistor 174 is connected between the inverting input and the output of the amplifier 166. The non-inverting input of the amplifier 166 is connected to ground potential. The output of the amplifier 166 functions to generate the crude pattern signal through a resistor 175 on the line 36.

The blending circuit 38 includes an amplifier 176 having an inverting input connected to receive the crude pattern signal on the line 36. A resistor 177 is connected between the inverting input and the output of the amplifier 176. A MOSFET switch has one terminal connected to the inverting input and another terminal connected to the output of the amplifier 176. The non-inverting input of the amplifier 176 is connected to the circuit ground potential. The ideal pattern signal on the line 34 is supplied to the non-inverting input of an amplifier 179 through a resistor 180. A resistor 181 is connected between the line 34 and the inverting input of an amplifier 176. The signal at the output of the amplifier 176 is applied to the non-inverting input of the amplifier 179 through a resistor 182. A capacitor 184 and a resistor 185 are connected in parallel between the inverting input and the output of the amplifier 179. The inverting input of the amplifier 179 is also connected to the ground potential through a resistor 183. The output of the amplifier 179 is connected to generate the actual pattern signal on the line 40.

The switch 178 receives a switching signal at a switching input on a line 186 connected to the output of an amplifier 187. A diode 188 has an anode connected to the inverting input and a cathode connected to the output of the amplifier 187. The non-inverting input of the amplifier 187 is connected to the circuit ground potential. An amplifier 189 has an inverting input connected to the −V power supply through a resistor 191. The non-inverting input of the amplifier 189 is connected to the circuit ground potential. A capacitor 192 is connected between the inverting input and the output of the amplifier 189. The +V power supply is connected through resistors 193 and 194 in series to the output of the amplifier 189. A MOSFET switch 195 has one terminal connected to the junction of the resistors 193 and 194 and another terminal connected to the inverting input of the amplifier 189.

The MOSFET switch 195 receives a switching signal at a switching input through a resistor 196 from the output of an amplifier 197. The amplifier 197 has an inverting input connected to receive the output of the amplifier 189 through a resistor 198. The output of the amplifier 189 is also supplied through a resistor 199 to the inverting input of the amplifier 187. A capacitor 201 is connected between the non-inverting input and the output of the amplifier 197. The non-inverting input of the amplifier 197 is connected to the circuit ground potential through a resistor 202.

The SLOWDOWN signal on the line 24 is supplied to the blending circuit to control a pair of MOSFET switches 203 and 204. The MOSFET switch 203 has one terminal connected to the +V power supply through a resistor 205. The same terminal is also connected to the anode of an internal diode 206 having a cathode connected to the circuit ground potential. The other terminal of the switch 203 is connected to the inverting input of an amplifier 207 having a non-inverting input connected to the circuit ground potential. The inverting input of the amplifier 207 is connected to the −V power supply through a resistor 208. A capacitor 209 and a diode 211 are connected in parallel between the inverting input and the output of the amplifier 207. The output of the amplifier 207 is supplied through a resistor 212 to the inverting input of the amplifier 187. The MOSFET switch 204 has one terminal connected to the +V power supply through a resistor 213. This same terminal is also connected to the anode of an internal diode 214 having a cathode connected to the circuit ground potential. The other terminal of the switch 204 is connected to the inverting input of the amplifier 187.

As previously mentioned, except for the initial portion of the deceleration pattern, the actual pattern signal on the line 40 is substantially identical to the ideal pattern signal on the line 34. The crude pattern circuit 35 and the blending circuit 38 of FIG. 4 function to generate a crude pattern signal which is blended with the ideal pattern signal during the initial portion of the deceleration pattern to produce an actual pattern signal which is altered with respect to the ideal pattern signal. Before the car reaches the slowdown point, the SLOWDOWN signal on the line 24 is at a low logic level which maintains the switches 149 and 150 in an on state. This maintains the integration circuitry associated with the amplifiers 153 and 159 in an inactive state. During this time, the TACH signal on the line 30 is supplied to the junction point 169 is reduced by a predetermined amount selected by the potentiometer 172. This reduced level is represented by voltage VR3 in FIG. 2c and FIG. 5c.

Basically, the amplifier 153 and its associated circuitry control the jerk rate of the crude pattern, while the amplifier 159 and its associated circuitry control the overall deceleration rate. When the SLOWDOWN signal is generated on the line 24, the switches 149 and 150 will turn off to permit the amplifiers 153 and 159 to begin integrating. The amplifier 153 begins to integrate a voltage at its inverting input which is set by the potentiometer 155. The output signal from the amplifier 150 is supplied to the input of the amplifier 159. The level of the input signal to the amplifier 159 can be controlled by adjusting the potentiometer 161. The amplifier 159 then integrates this signal to reduce the level at the junction point 169 which has been preset with the reduced tach voltage. The signal at the junction point 169 is scaled by the amplifier 166 and its associated circuitry and generated as the crude pattern signal on the line 36.

The upper portion of the blending circuit 38 in FIG. 4 generates a control signal on the line 186 to control the blending of the crude pattern signal on the line 36 with the ideal pattern signal on the line 34. Before slowdown, the control signal on the line 186 is at a low level such that the switch 178 is in an on state. When the switch 178 is on, identical potential level signals appear at the inverting input and the output of the amplifier 176. The resistors 180 and 182 are chosen with identical values such that the ideal pattern signal will be supplied to the amplifier 179, which functions as a non-inverting amplifier, to generate the actual pattern signal on the line 40.

When slowdown is reached, the upper portion of the circuitry in FIG. 4 begins to generate a control signal on the line 186 to turn the switch 178 on and off. When the switch 178 is off, the crude pattern signal at the inverting input of the amplifier 176 will be amplified and applied to the amplifier 179 through the resistor 182. The signal on the line 186 is a square waveform with a duty cycle which decreases over a predetermined time period. This results in the crude pattern signal being weighted more heavily at the beginning of the blending period while the ideal pattern signal is weighted more heavily at the end of the blending time period. Basically, the circuitry in the upper portion of FIG. 4 functions to generate a waveform signal on the line 186 similar to the waveform shown in FIG. 5b. This waveform is generated over the time period T which corresponds to that segment of the pattern signal (shown in FIG. 2c) in which the crude pattern signal is blended with the ideal pattern signal. The waveform shown in FIG. 5b is generated by first generating a sawtoothed waveform at the output of the amplifier 189 similar to the waveform shown in FIG. 5a. The amplifiers 189 and 197 and their associated circuitry function to generate such a waveform.

Prior to slowdown, the SLOWDOWN signal on the line 24 is low such that the switches 203 and 204 are in the on state. This maintains the inverting input to the amplifier 207 at a positive potential and also maintains the inverting input to the amplifier 187 at a positive potential. Consequently, the line 186 is low such that the switch 178 is in the on state before slowdown. At slowdown, the line 24 will go high to turn off the switches 203 and 204. This causes the amplifier 207 and its associated circuitry to begin to integrate positive. The output of the amplifier 207 will gradually change from a zero potential to a +V potential. The voltage at the output of the amplifier 207 determines the duty cycle of the square waveform on the line 186 by controlling the voltage level at which the amplifier 187 switches. Initially, the duty cycle is approximately one hundred percent. As the voltage at the output of the amplifier 207 becomes more negative, the duty cycle decreases.

Figure 5C:
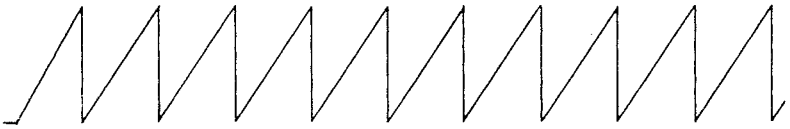
Figure 5C:
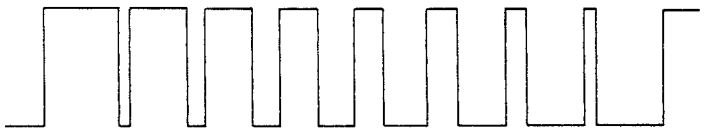
Figure 5C:
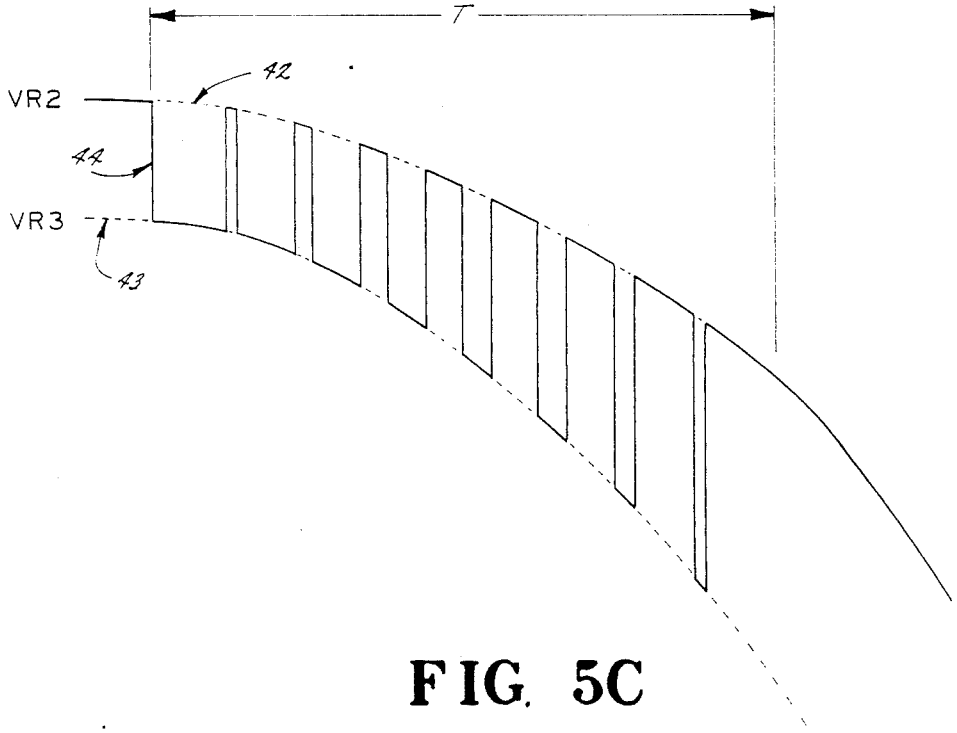

Referring to FIG. 5c, there is shown the manner in which the crude pattern signal and ideal pattern signals are blended by utilizing the control waveform shown in FIG. 5b. As shown in FIG. 5c, the actual pattern signal is initially at the ideal pattern value until the beginning of the time period T. At that point, the control waveform of FIG. 5b turns off the switch 178 such that the crude pattern signal is now supplied to the input of the amplifier 176. When the switch 178 is turned on again, the pattern signal returns to the value of the ideal pattern signal. Initially, as shown in FIG. 5*c* the crude pattern signal is favored over the ideal pattern. However, as the end of the time period T is reached, the ideal pattern is favored more heavily.

Figure 6:
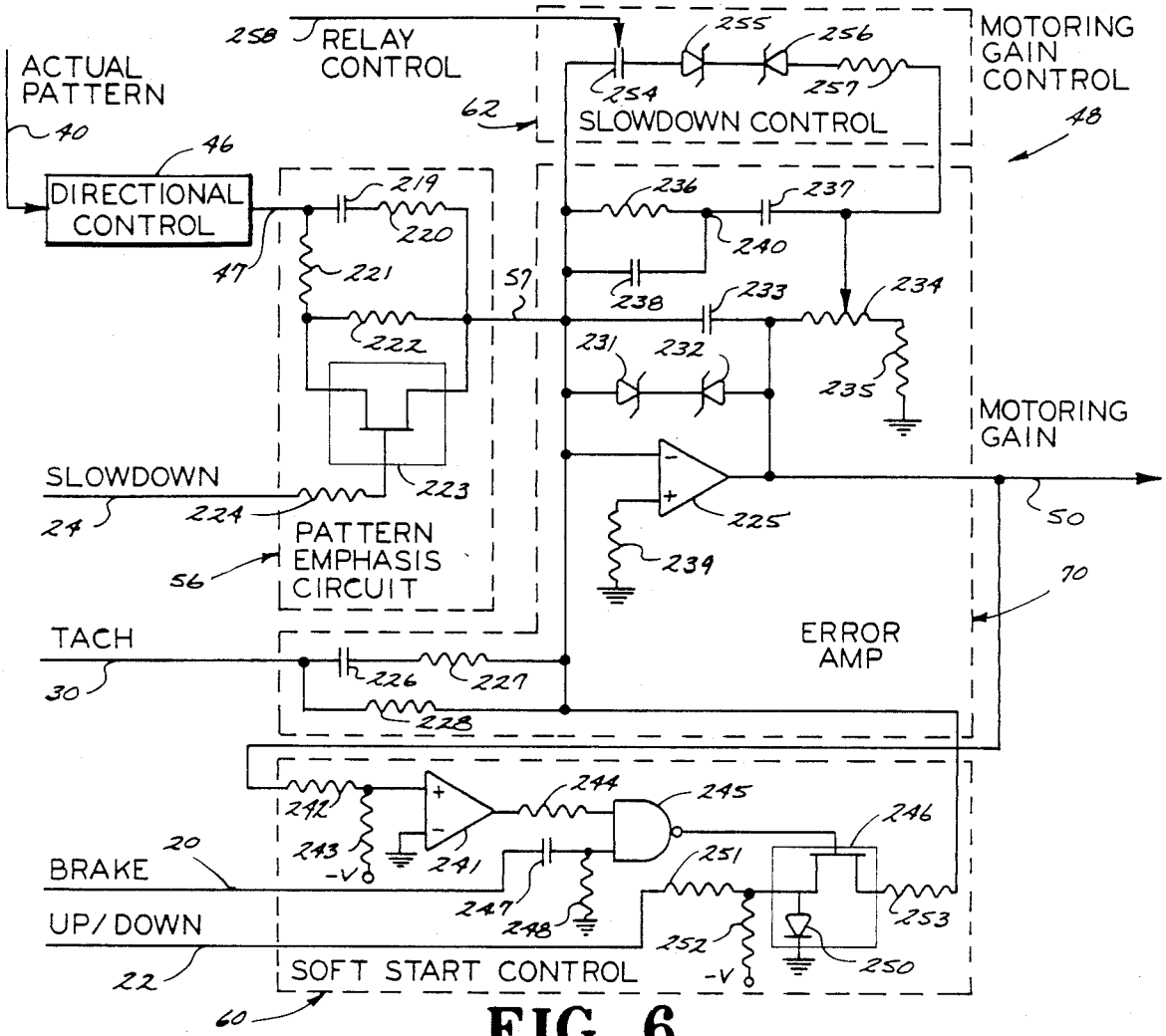
FIG. 6 is a schematic diagram illustrating the motoring gain control circuit of FIG. 1.

Referring to FIG. 6, there is shown a schematic diagram of the motoring gain control circuit 48 of FIG. 1. The pattern signal from the directional control circuit 46 is supplied on a line 47 as an input to the pattern emphasis circuit 56. The line 47 is connected to the line 57 through a capacitor 219 and a resistor 220 in series. The line 47 is also connected to line 57 through a resistor 221 and a resistor 222 connected in series. A MOSFET switch 223 is connected to receive the SLOWDOWN signal on the line 24 through a resistor 224 at a switching input. A pair of terminals of the switch 223 are connected to opposite ends of the resistor 222.

The error amplifier 70 includes an amplifier 225 having an inverting input connected to receive the directional pattern signal on the line 57. The TACH signal on the line 30 is supplied to the line 57 through a capacitor 226 and a resistor 227 connected in series. A resistor 228 is also connected between the line 30 and the line 57. The resistors 221 and 222 are selected with values whose sum correspond to the value of the resistor 228. Before slowdown, the switch 223 is maintained in the on state such that the resistor 222 is effectively shorted and the pattern signal will be supplied to the line 57 at a level somewhat higher than if the switch 223 was in the off state. Thus, before slowdown, the amplifier 225 will see a pattern signal on the line 57 which is emphasized with respect to the TACH signal. As will be discussed, this enables the amplifier 225 to generate a motoring gain signal during a full speed run at a level VM3 (shown in FIG. 7*b*) such that the SCR's are maintained in a full on state. This prevents the SCR's from being switched on and off in order to maintain the TACH signal level at the pattern signal level.

A pair of zener diodes 231 and 232 have their cathodes connected together and their anodes connected between the inverting input and output of the amplifier 225. A capacitor 233 is connected between the inverting input and the output of the amplifier 225. A potentiometer 234 has one fixed terminal connected to the output of the amplifier 225 and the other fixed terminal connected to the ground potential through a resistor 235. A resistor 236 and a capacitor 237 are connected in series between the input of the amplifier 225 and the variable terminal of the potentiometer 234. A capacitor 238 is connected in parallel with the resistor 236. The non-inverting input of the amplifier 225 is connected to the ground potential through a resistor 239.

Figure 7A:
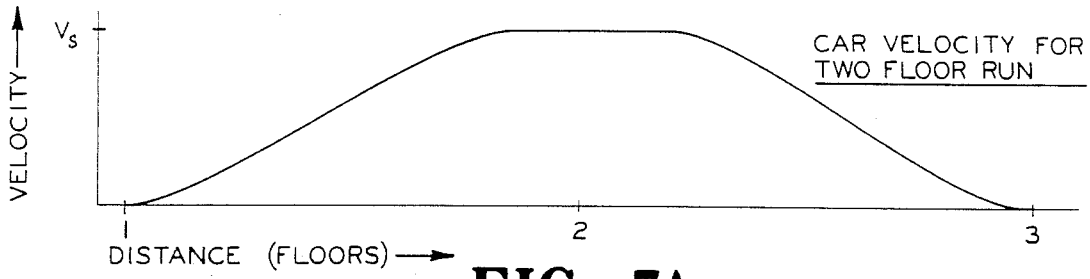
FIG. 7*a* is a waveform diagram illustrating the speed of an elevator car over a two floor run.
Figure 7B:
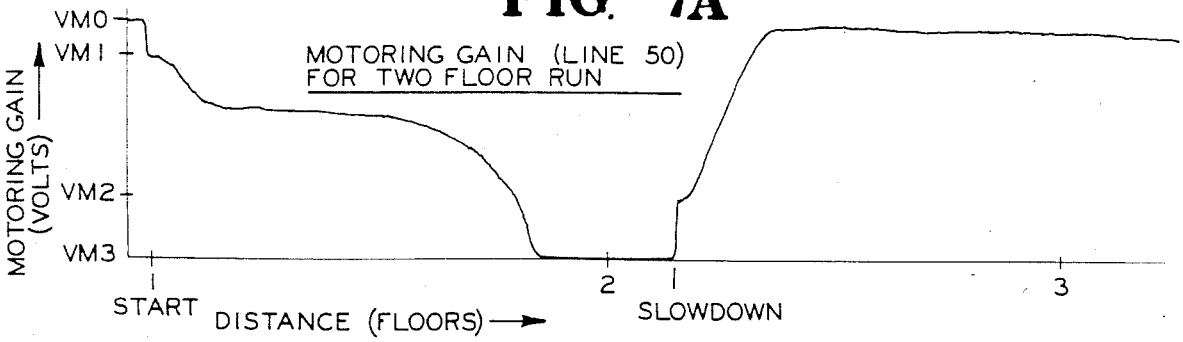
FIG. 7*b* is a waveform diagram illustrating the motoring gain signal generated by the circuit of FIG. 6.

The output of the amplifier 225 is connected to generate the motoring gain signal on the line 50. An example of a motoring gain signal for a two floor run is shown in FIG. 7*b*. FIG. 7*a* illustrates the car velocity over this two floor run. Basically, the amplifier 225 functions to generate a motoring gain signal representative of the error between the pattern signal on the line 40 and the TACH signal on the line 30. As previously mentioned, before slowdown, the pattern signal is emphasized with respect to the TACH signal. Consequently, it appears to the amplifier as if the actual speed of the car is less than the pattern signal. This causes the amplifier 225 to saturate and generate a motoring gain signal at a voltage level VM3 during a full speed condition. This VM3 potential is selected to be several volts higher than the upper edge of the active region of SCR's which is shown in FIG. 7*b* as approximately VM2 volts. Consequently, the SCR's are maintained in a full on condition during a full speed run. By maintaining the SCR's in a full on condition, the circuit is able to take advantage of the regeneration in the AC motor to reduce the motor speed in an overhauling condition.

Also shown in FIG. 6 is the soft start control circuit 60 and the slowdown control circuit 62. As will be discussed, these two circuits are utilized to preset the motoring gain signals during specified time periods in a car run in order to provide for smoother operation. As shown in FIG. 6, the soft start control circuit 60 receives the motoring gain signal on the line 50. The line 50 is connected to the non-inverting input of an amplifier 241 through a resistor 242. The non-inverting input of the amplifier 241 is connected to the −V power supply through a resistor 243. The inverting input of the amplifier 241 is connected to the circuit ground potential.

The output of the amplifier 241 is connected through a resistor 244 to one input of a NAND gate 245 having an output connected to the switching terminal of a MOSFET switch 246. The other input of the NAND gate 245 is connected to receive the BRAKE signal on the line 20 through a capacitor 247. The second input of the NAND 245 is also connected to the circuit ground potential through a resistor 248. The MOSFET switch 246 includes an internal diode 250 having an anode connected to one terminal of the switch 246 and a cathode connected to the circuit ground potential. The same terminal of the switch 246 is connected to receive the UP/DOWN signal on the line 22 through a resistor 251. This terminal of the switch 246 is also connected to the −V power supply through a resistor 252. The other terminal of the switch 246 is connected through a resistor 253 to the input line 57 of the error amplifier 70.

Basically, the soft start control 60 is utilized to preset the output of the error amplifier 70 at a level VM1 (shown in FIG. 7*b*) slightly below the lower edge of the active region of the SCR's. The amplifier 241 of the soft start control 60 functions as a comparator to generate a high level signal to the input of the NAND 245 when the motoring gain signal is above a predetermined level. The level is selected to be between the levels VM0 and VM1 in FIG. 7*b*. When the brake releases, the BRAKE signal on the line 20 will go high and will momentarily apply a high level signal logic "1" to the second input of the NAND 245 until the capacitor 247 has charged through the resistor 248. This causes the NAND to momentarily generate a low level signal at the output to turn on the switch 246.

When the switch 246 is turned on, a voltage appearing at the junction between the resistors 251 and 252 will be supplied through the resistor 253 to the line 57. The polarity of the voltage supplied to the line 57 is controlled in accordance with the directional travel of the car. If the car is traveling in an up direction, a positive polarity voltage will be supplied to the line 57 while, if the car is traveling in a down direction, a negative polarity signal will be supplied to the line 57. This voltage, which is momentarily applied to the line 57, causes the motoring gain signal to drop from the VM0 level to the VM1 level shown in FIG. 7*b*. As previously mentioned, the VM1 is selected to be slightly below the lower edge of the active region of the SCR's. By presetting the motoring gain signal at this level, the delay associated with prior art circuits is eliminated.

Also shown in FIG. 6 is the slowdown control circuit 62. This circuit includes a set of relay contacts 254 having one terminal connected to the line 57 and having another terminal connected to the anode of a zener diode 255. The cathode of the diode 255 is connected to the cathode of another zener diode 256 having an anode connected to the variable terminal of the potentiometer 234 through a resistor 257. The relay 254 receives a relay control signal on a line 258.

Normally, the relay contacts 254 will be open such that the slowdown circuit 62 has no effect on the operation of the error amplifier 70. However, at the slowdown point, the relay 254 receives a signal on the line 258 which momentarily closes the contacts to cause the slowdown circuitry to be connected in parallel across the capacitor 233 and the resistor 236. The reverse breakdown voltages of the diodes 255 and 256 are selected such that, when the relay contacts are closed, the output of the error amplifier 70 is pulled to the VM2 level. Thus, when slowdown is reached, the circuit 62 is inserted into the amplifier 70 and causes the output to switch from a full on VM3 level to the VM2 level which is slightly above the upper edge of the active region of the SCR's. As shown in FIG. 7*b*, this enables the amplifier to immediately begin tracking the pattern signal and prevents any delay which would be normally be caused by having the amplifier 225 follow the actual error between the pattern signal and the TACH signal.

Figure 8:
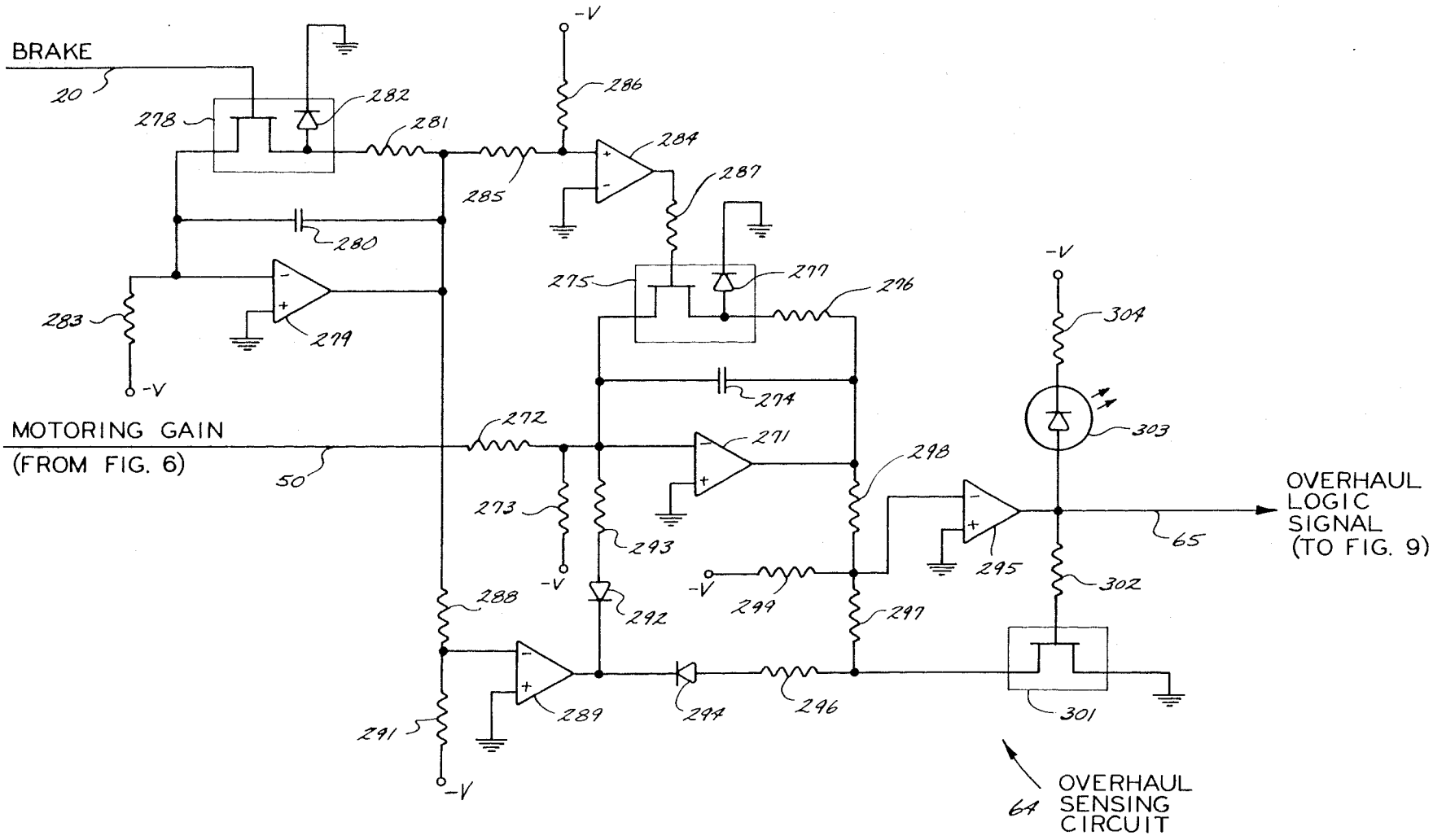
FIG. 8 is a schematic diagram of the overhaul sensing circuit of FIG. 1.

Referring to FIG. 8, there is shown a schematic diagram of the overhaul sensing circuit 64 of FIG. 1. The overhaul sensing circuit 64 receives the motoring gain signal on the line 50 from the error amplifier 58. The line 50 is connected to the inverting input of an amplifier 271 through a resistor 272. The inverting input of the amplifier 271 is also connected to the −V potential through a resistor 273. The non-inverting input of the amplifier 271 is connected to the circuit ground potential. A capacitor 274 is connected between the inverting input and the output of the amplifier 271. A MOSFET switch 275 has one terminal connected to the inverting input of the amplifier 271 and another terminal connected to the output of the amplifier 271 through a resistor 276. The MOSFET switch 275 includes an internal diode 277 connected to pull the second terminal to the ground potential.

The overhaul sensing circuit also receives the BRAKE signal on the line 20. The line 20 is connected to the switching input of a MOSFET switch 278. One terminal on the MOSFET switch 278 is connected to the inverting input of an amplifier 279, while the other terminal is connected to the output of the amplifier 279 through a resistor 281. The other terminal of the switch 278 is pulled to ground potential through an internal diode 282. The inverting input of the amplifier 279 is connected to the −V power supply through a resistor 283. The non-inverting input of the amplifier 279 is connected to the circuit ground potential.

A capacitor 280 is connected between the inverting input and the output of the amplifier 279. The output of the amplifier 279 is connected to the non-inverting input of an amplifier 284 through a resistor 285. The non-inverting input of the amplifier 285 is connected to the −V power supply through a resistor 286. The inverting input of the amplifier 284 is connected to the circuit ground potential. The output of the amplifier 284 is connected to generate a control signal to the switching terminal of the MOSFET switch 275 through a resistor 287.

The output of the amplifier 279 is also connected through a resistor 288 to the inverting input of an amplifier 289. The inverting input of the amplifier 289 is connected to the −V power supply through a resistor 291. A non-inverting input of the amplifier 289 is connected to the circuit ground potential. The output of the amplifier 289 is connected to the cathode of a diode 292 having an anode connected to the inverting input of the amplifier 271 through a resistor 293. The output of the amplifier 289 is also connected to the cathode of another diode 294 having an anode connected to the inverting input of an amplifier 295 through a resistor 296 and a resistor 297 in series.

The inverting input of the amplifier 295 is connected to receive the output of the amplifier 271 through a resistor 298. The −V power supply is connected to the inverting input of the amplifier 295 through a resistor 299. A MOSFET switch 301 has one terminal connected to the junction of the resistors 296 and 297 and another terminal connected to the circuit ground potential. The switching terminal of the MOSFET switch 301 is connected to receive a switching signal from the output of the amplifier 295 through a resistor 302. An LED 303 has an anode connected to the output of the amplifier 295 and a cathode connected to the −V power supply through a resistor 304. The amplifier 295 is connected to generate the overhaul logic signal on the line 65.

The overhaul sensing circuit of FIG. 8 functions to monitor the motoring gain signal during the acceleration of the car in order to determine whether or not an overhaul condition exists. If such a condition exists, the overhauling circuit will generate an overhaul logic signal on the line 65 which signal, as will be discussed, is utilized to alter the gain of the braking circuit in order to provide for smoother deceleration of the car.

Basically, the overhaul sensing circuit functions to monitor the motoring gain signal on the line 50 for a predetermined time interval during an acceleration run to determine whether the car is in a hauling or an overhauling condition. The amplifier 271 and its associated circuitry is connected to integrate the motoring gain signal on the line 50. The time period during which the amplifier 271 integrates the motoring gain circuit is controlled by the amplifiers 279, 284, 289 and their associated circuitry. If the output of the amplifier 271 reaches a predetermined level during that time period, this indicates that a hauling load condition exists. However, if the amplifier 271 does not reach the predetermined level within this time period, an overhauling condition exists.

The amplifier 279 and its associated circuitry functions as an integrator which begins integrating a voltage at its inverting input when the brake is released to turn off the switch 278. The amplifiers 284 and 289 function as comparators. When the output of the amplifier 279 reaches a first predetermined value (determined by the value of the resistor 285), the output of the amplifier 284 will go high to turn off the switch 275. This enables the amplifier 271 to begin integrating. The amplifier 271 will continue to integrate the motoring gain signal until either the output of the amplifier 271 reaches a second predetermined value (predetermined by the value of the resistor 298), or the output of the amplifier 279 reaches a third predetermined value (determined by the value of the resistor 288), indicating the end of the time interval.

If the amplifier 271 reaches the second predetermined value before the end of the time interval, this indicates that a hauling condition exists. This causes the amplifier 295 to go negative and to turn on the switch 301 to prevent the output of the comparator 289 from triggering the comparator 295. If the output of the amplifier 271 has not reached the second predetermined value at the end of the time period, the output of the amplifier 289 will go negative to supply a negative signal to the inverting input of the amplifier 295 and maintain the overhaul logic signal on the line 65 in a positive condition. This indicates that an overhauling condition exists. As will be discussed, the overhauling logic signal, if positive, is utilized to reduce the gain of the braking amplifier during deceleration of the car.

Figure 9:
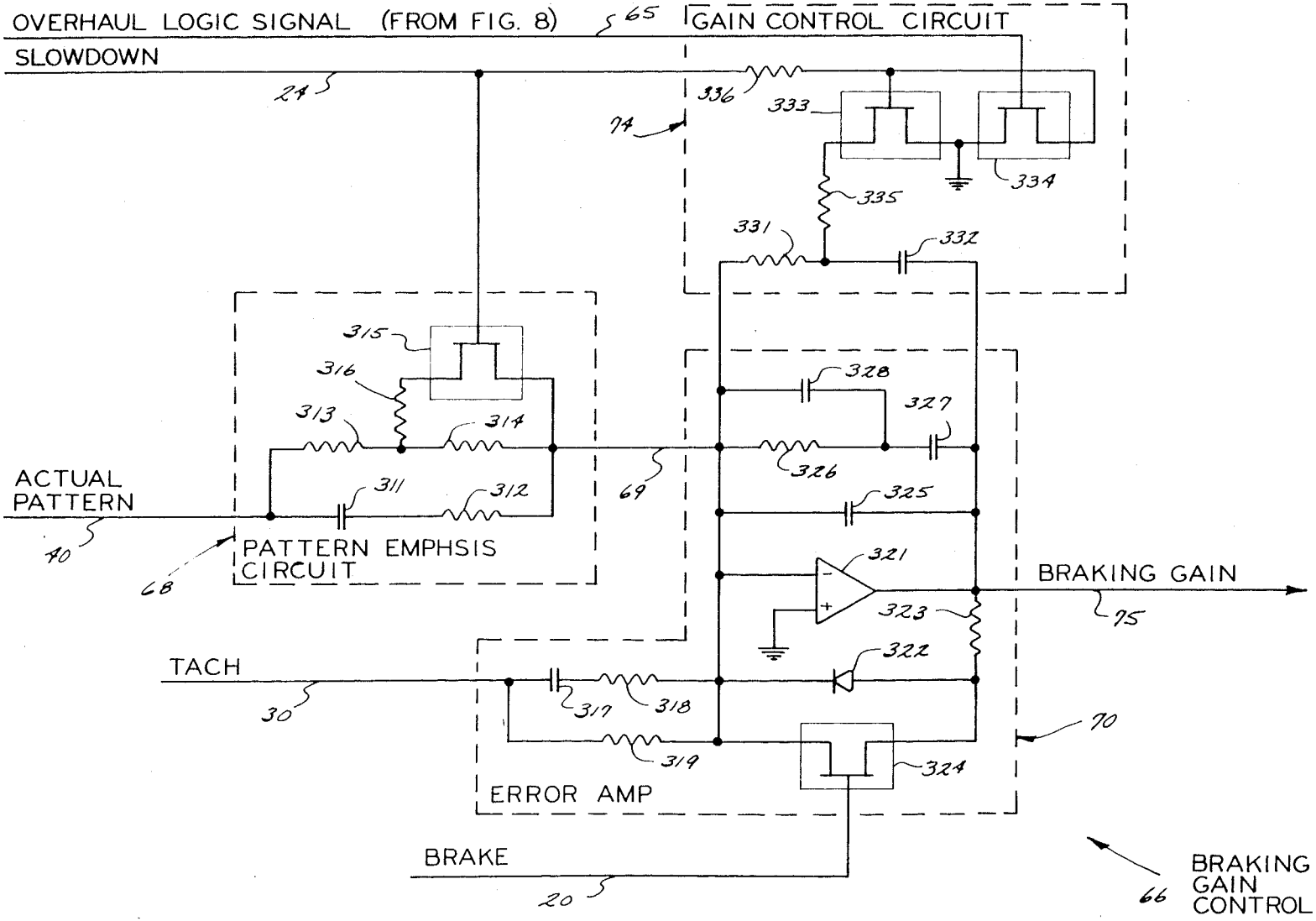
FIG. 9 is a schematic diagram of the braking gain control circuit of FIG. 1.

Referring to FIG. 9, there is shown a schematic diagram of the braking gain control circuit 66 of FIG. 1. The braking gain control circuit 66 includes the pattern emphasis circuit 68 similar to the pattern emphasis circuit 56 of the motoring gain control circuit 48. The pattern signal on the line 40 is supplied to the error amplifier 70 on the line 69 through a capacitor 311 and a resistor 312 connected in series. A resistor 313 and a resistor 314 are also connected in series between line 40 and the line 69. A MOSFET switch 315 has a switching input connected to receive the SLOWDOWN signal on the line 24. The switch 315 has one terminal connected to the line 69 and another terminal connected between the resistors 313 and 314 through a resistor 316.

The TACH signal on the line 30 is supplied to the line 69 through a capacitor 317 and a resistor 318 connected in series. Another resistor 319 is connected between the line 30 and the line 69. Typically, the capacitors 311 and 317 are selected with the same value, as are the resistors 312 and 318. The resistors 313 and 314 are selected with values such that their sum is slightly less than the value of the resistor 319. The value of the resistor 316 is chosen such that, at slowdown when the switch 315 is on, the effective resistance of the resistors 313, 314, and 316 is less than the resistance of the resistor 319. Thus, before slowdown, when the switch 315 is in the on state, the pattern signal will be supplied to the line 69 at a level slightly higher than if the switch 315 were off.

The braking gain control circuit includes an amplifier 321 having an inverting input connected to the line 69. The non-inverting input of the amplifier 321 is connected to the circuit ground potential. A diode 322 has an anode connected to the output of the amplifier 321 through a resistor 323 and a cathode connected to the line 69. A MOSFET switch 324 has terminals connected across the diode 322 and has a switching input connected to receive the BRAKE signal on the line 20. The output of the amplifier 321 is connected to generate the braking gain signal on the line 75. A capacitor 325 is connected between the inverting input and the output of the amplifier 321. A resistor 326 and a capacitor 327 are connected in series between the inverting input and the output of the amplifier 321. Another capacitor 328 is connected across the resistor 326.

The amplifier 321 and its associated circuitry functions to integrate the difference between the pattern and tach signals generated on the line 69 and generate the braking gain control signal on the line 75. When the brake is engaged, the BRAKE signal is at a low level and the switch 324 will be on such that the output of the amplifier 321 is near ground potential to maintain the eddy current brake 16 in an off state.

Also shown in FIG. 9 is the braking gain control circuit 74. The control circuit 74 includes a resistor 331 and a capacitor 332 connected in series between the inverting input and the output of the amplifier 321. The braking gain control circuit 74 includes a pair of MOSFET switches 333 and 334 each having one terminal connected to the circuit ground potential. The other terminal of the switch 333 is connected between the resistor 331 and the capacitor 332 through a resistor 335, while the other terminal of the switch 334 is connected to the switching input of the switch 333. The switch 333 has a switching input connected to receive the SLOWDOWN signal on the line 24 through a resistor 336, while the switch 334 has a switching input connected to receive the overhaul logic signal on the line 65.

If the overhaul logic signal is at a low level, the switch 334 will be in the on state such that a low level signal is applied to turn on the switch 333. This effectively grounds the junction between the resistors 331 and the capacitor 332 such that the capacitor 332 and the resistor 331 have no effect on the integration of the amplifier 321. However, if the overhaul logic signal is positive, the switch 334 will be in the off state. Before slowdown, the switch 333 is in the on state such that the capacitor 332 and the resistor 331 do not effect the integrating of the amplifier 321. However, once slowdown is reached, the switch 333 will turn off, thereby inserting the resistor 331 and the capacitor 332 into the feedback loop of the amplifier 321. This reduces the overall gain of the braking amplifier during the slowdown time period if an overhaul condition has been detected. Reducing the gain of the braking error amplifier causes the response time of the error amplifier to be increased. This causes the motoring gain amplifier to more rapidly reduce the motoring gain signal to slow the car. When the motoring gain has been reduced, the braking error amplifier will then begin to operate the eddy current brake to further slow the car.

It should be noted that in some instances, instead of decreasing the response time of the braking amplifier at slowdown when an overhauling condition is sensed, it may be desirous to increase the response time of the motoring gain amplifier during this time. This could be accomplished by using circuitry similar to that in the braking gain control circuit 74. For example, a circuit similar to the circuit 74 could be responsive to a slowdown condition and an overhauling condition to increase the gain of the motoring error amplifier 58 during slowdown if an overhauling condition is sensed.

In accordance with the provisions of the patent statutes, the principle and mode of operation of the invention have been explained and illustrated in its preferred embodiment. However, it must be understood that the invention can be practiced otherwise than as specifically illustrated and described without departing from its spirit or scope.

What is claimed is:

1. In an elevator system including a drive motor coupled to control the position of an associated elevator car, a control circuit comprising:

means for generating a tach signal representing the actual speed of the car;

means for generating a pattern signal representing the desired speed of the car, said pattern signal including a deceleration portion, said means for generating a pattern signal being responsive to the tach signal for setting the initial level of the deceleration portion of said pattern signal at a value which is a function of the level of the tach signal; and means responsive to the tach signal and the pattern signal for controlling the drive motor.

2. The control circuit according to claim 1 wherein said means for generating a pattern signal includes an ideal pattern circuit for generating an ideal pattern signal, a crude pattern circuit for generating a crude pattern signal and a blending circuit responsive to said ideal pattern signal and said crude pattern signal for generating said pattern signal.

3. The control circuit according to claim 2 including means for generating a slowdown signal when the car is to stop and wherein said blending circuit is responsive to said slowdown signal for generating said pattern signal as a predetermined combination of said ideal pattern signal and said crude pattern signal.

4. The control circuit according to claim 2 including means for generating a slowdown signal when the car is to stop and wherein said blending circuit generates said pattern signal as said ideal pattern signal and is responsive to said slowdown signal for generating said pattern signal as a predetermined combination of said ideal signal and said crude pattern signal pattern.

5. The control circuit according to claim 3 or 4 wherein said blending circuit generates said pattern signal as a predetermined combination of said ideal pattern signal and said crude pattern signal by first favoring said crude pattern signal and later favoring said ideal pattern signal.

6. In an elevator system including a drive motor and an eddy current brake coupled to control the position of an associated elevator car, and means for generating a tach signal representing the actual speed of the car, a control circuit comprising:

means for generating a pattern signal representing the desired speed of the car over a predetermined distance, the pattern signal including a deceleration portion;

means responsive to the tach signal and the pattern signal for generating a braking gain signal within a predetermined response time for controlling the eddy current brake; and means responsive to an overhauling condition of the elevator car for increasing said predetermined response time of said braking gain signal generating means during the deceleration portion of the pattern signal.

7. The control circuit according to claim 6 including means responsive to the tach signal and said pattern signal for generating a motoring gain signal for controlling the drive motor and wherein said means for decreasing said predetermined response time is responsive to said motoring gain signal for sensing an overhauling condition.

8. The control circuit according to claim 7 wherein said means for decreasing said predetermined response time decreases the gain of said braking gain signal generating means during the deceleration portion of the pattern signal.

9. In an elevator system including a drive motor and an eddy current brake coupled to control the position of an associated elevator car, means for generating a tach signal representing the actual speed of the car, and means for generating a pattern signal representing the desired speed of the car over a predetermined distance, the pattern signal including a deceleration portion, a control circuit comprising:

means responsive to the tach signal and the pattern signal for generating a motoring gain signal within a predetermined response time for controlling the drive motor; and means responsive to an overhauling condition of the elevator car for decreasing the response time of said motoring gain signal generating means during the deceleration portion of the pattern signal.

10. The control circuit of claim 9 wherein said means for decreasing the response time includes means responsive to the tach signal and the pattern signal for generating a braking gain signal within a predetermined response time for controlling the eddy current brake and means responsive to the overhauling condition for increasing said predetermined response time of said braking gain signal generating means during the deceleration portion of the pattern signal.

11. In an elevator system including a drive motor and an eddy current brake coupled to control the position of an associated elevator car, the drive motor connected to receive power from an SCR firing circuit, and means for generating a tach signal representing the actual speed of the car, a control circuit comprising:

means for generating a pattern signal representing the desired speed of the car; and means responsive to the tach signal and the pattern signal for generating a motoring gain signal for controlling the SCR firing circuit, said motoring gain signal generating means being responsive to a signal representing the initial start-up of the car for setting the motoring gain signal at a level corresponding to the active region of the SCR's.

12. The control circuit according to claim 11 wherein said motoring gain signal generating means includes a soft start control responsive to a release of the eddy current brake and said motoring gain signal for controlling said motoring gain signal at a level just below the level at which the SCR's begin to turn on.

13. The control circuit according to claim 11 wherein said motoring gain signal generating means includes a slowdown control responsive to an initiation of deceleration of the car for controlling said motoring gain signal at a level corresponding to the upper edge of the active region of the SCR's.

14. The control circuit of claim 11 including a pattern emphasis circuit responsive to said pattern signal for controlling said motoring gain signal at a level above the active region of the SCR's.

15. In an elevator system including a drive motor coupled to control the position of an associated elevator car, the drive motor connected to receive power from an SCR firing circuit, means for generating a tach signal representing the actual speed of the car, and means for generating a pattern signal representing the desired speed of the car over a predetermined distance, the pattern signal including a full speed portion and a deceleration portion, a control circuit comprising:

means responsive to a slowdown signal for switching the pattern signal from the full speed portion to the deceleration portion; and means responsive to the tach signal and the pattern signal for generating a motoring gain signal for controlling the SCR firing circuit, said means being responsive to the full speed portion of the pattern signal for generating the motoring gain signal at level a predetermined amount above the upper edge of the active region of the SCR's, said means being responsive to the slowdown signal for setting the level of the motoring gain signal at the upper edge of the active region of the SCR's.

16. The control circuit of claim 15 wherein said means for generating a motoring gain signal includes a pattern emphasis circuit responsive to the pattern signal and the absence of said slowdown signal for controlling said motoring gain signal at a level above the active region of the SCR's.

17. The control circuit of claim 15 wherein said means for generating a motoring gain signal includes a soft start control for controlling said motoring gain signal at a level just below the active region of the SCR's in response to a brake signal indicating that the car is starting.

18. The control circuit of claim 15 wherein said means for generating a motoring gain signal includes a slowdown control responsive to a slowdown signal for controlling said motoring gain signal at a level corresponding to the upper edge of the active region of the SCR's.

* * * * *